US005979323A

United States Patent [19]

Hirano

[11] Patent Number: 5,979,323

[45] Date of Patent: Nov. 9, 1999

[54] METHOD OF PRODUCING AN IMPREGNATION STAMP AND AN IMPREGNATION STAMP PRODUCED THEREBY

[75] Inventor: Koichi Hirano, Yokohama, Japan

[73] Assignee: Mitsubishi Pencil Kabushiki Kaisha, Tokyo, Japan

[21] Appl. No.: 09/004,594

[22] Filed: Jan. 8, 1998

[30] Foreign Application Priority Data

May 1, 1997 [JP] Japan ..... 9-113956

[51] Int. Cl.[6] ..... B41C 1/02

[52] U.S. Cl. ..... 101/401.1; 101/333; 101/108

[58] Field of Search ..... 101/401.1, 401.2, 101/401.3, 327, 333, 115, 171, 202, 211, 151, 194, 97, 98, 101, 108

[56] References Cited

U.S. PATENT DOCUMENTS 2,864,310 12/1958 Nelson ..... 101/327
3,536,007 10/1970 Harvey ..... 101/327
4,481,528 11/1984 Peck ..... 358/75
5,636,568 6/1997 Dugan ..... 101/211

*Primary Examiner*—Edgar Burr
*Assistant Examiner*—Dave A Ghatt
*Attorney, Agent, or Firm*—Darby & Darby

[57] ABSTRACT

In order to supply a multiple number of inks at a desired geometry, a filling frame has filling ports of substantially vertical passage holes. A stamp piece has a continuous porous structure and is placed on a base plate with the filling framed laid thereover. Each ink is supplied from a corresponding filling port to a separated area and is impregnated into a stamp piece in substantially the same geometry as that of separated area so that each will not mix with the other. Thus, inks are filled keeping the separation, into the stamp piece having a continuous porous structure laid below the filling frame.

5 Claims, 7 Drawing Sheets

METHOD OF PRODUCING AN IMPREGNATION STAMP AND AN IMPREGNATION STAMP PRODUCED THEREBY

BACKGROUND OF THE INVENTION (1) Field of the Invention

The present invention relates to a method of producing an impregnation stamp which can be used for repeated stamping of the impression and an impregnation stamp produced by the method.

(2) Description of the Prior Art

Conventionally, ink impregnation into an impregnation stamp has been mainly performed by dipping it in ink or by adding ink dropwise from the rearside of the stamp piece whilst heating as required so that the ink will impregnate into the stamping material having a continuous porous structure. However, when these methods are used to impregnate ink into an impregnation stamp, one stamp piece can be filled up with only one kind of ink, thus making it impossible to produce a multi-colored stamp or a stamp with a stamp piece filled up with multiple types of inks having different functions.

In order to solve such drawbacks, there has been a stamp which enables a single stamping action to form a multi-color impression by combining a plurality of stamp pieces in a single holder, each having a different kind of ink impregnated therein.

Nevertheless, a device of this type leaves traces of the seams between the stamp pieces, from its structure, giving rise to a feeling of raggedness. Further, if the boundaries between the stamp pieces are located across a continuous pattern, the traces of the seams will appear in the impression.

SUMMARY OF THE INVENTION

The present invention has been devised to solve the above conventional problems, and it is therefore an object of the present invention to provide a production method of an impregnation stamp and an impregnation stamp produced by the method, whereby an impression consisting of plural kinds of inks can be formed at a single stamping action without leaving any seams.

In order to achieve the above object, the present invention is configured as follows:

In accordance with the first aspect of the invention, a method of producing an impregnation stamp with a stamp piece of a continuous porous structure filled with ink to enable repeated stamping, comprises the steps of:

laying a filling frame with a plurality of filling ports of substantially vertical passage holes over a stamp piece having a continuous porous structure; and injecting plural kinds of ink, at least two kinds of ink, to respective filling ports to thereby supply plural types ink into the stamp piece.

In accordance with the second aspect of the invention, the method of producing an impregnation stamp having the above first feature is characterized in that in the step of laying the filling frame, a diffusion sheet which is permeable by ink and allows the impregnated ink to diffuse therein by capillary effect is placed between the filling frame and the stamp piece.

In accordance with the third aspect of the invention, the method of producing an impregnation stamp having the above second feature is characterized in that the capillary force of the diffusion sheet is set weaker than that of the stamp piece.

In accordance with the fourth and fifth aspects of the invention, the method of producing an impregnation stamp having the above first or second feature is characterized in that in the step of laying the filling frame, the filling frame is put in pressure contact with the stamp piece.

In accordance with the sixth aspect of the invention, an impregnation stamp is produced by a method of lying a filling frame with a plurality of filling ports of substantially vertical passage holes over a stamp piece having a continuous porous structure, and injecting plural kinds of ink, at least two kinds of ink, to respective filling ports to thereby supply plural types ink into the stamp piece.

In accordance with the seventh aspect of the invention, the impregnation stamp having the above sixth feature is characterized in that a diffusion sheet which is permeable by ink and allows the impregnated ink to diffuse therein by capillary effect is placed between the filling frame and the stamp piece.

In accordance with the eighth aspect of the invention, the impregnation stamp having the above seventh feature is characterized in that the capillary force of the diffusion sheet is set weaker than that of the stamp piece.

In accordance with the ninth and tenth aspects of the invention, the impregnation stamp having the above sixth or seventh feature, is characterized in that the filling frame is put in pressure contact with the stamp piece.

DESCRIPTION OF THE PREFERRED EMBODIMENTS

Figure 1:
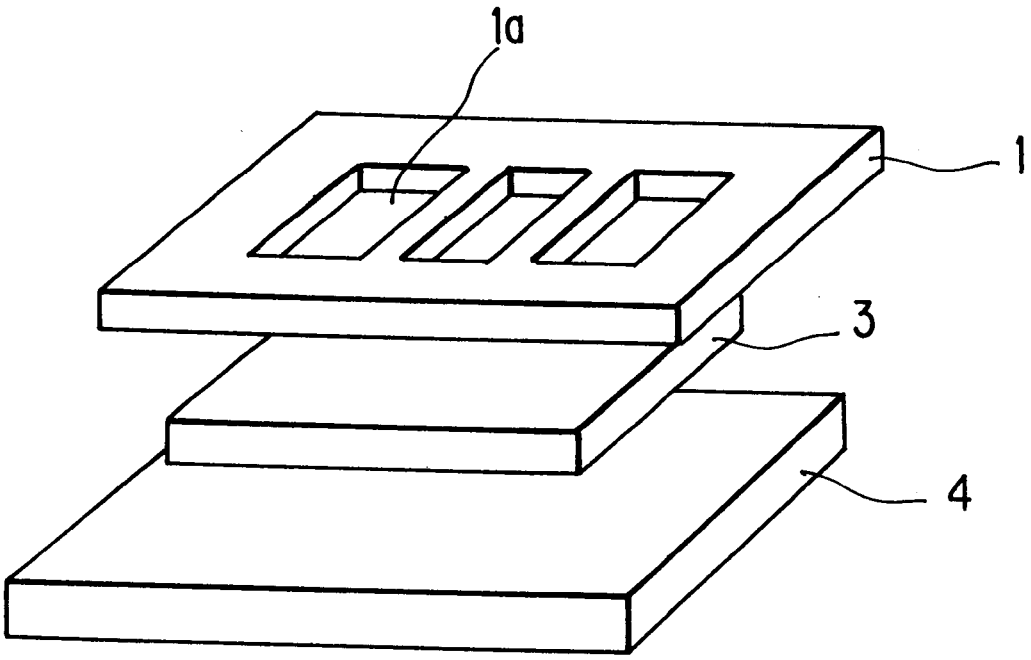
FIG. 1 is an exploded perspective view showing an embodiment of a filling jig to be used for a production method of an impregnation stamp of the invention.
Figure 2:
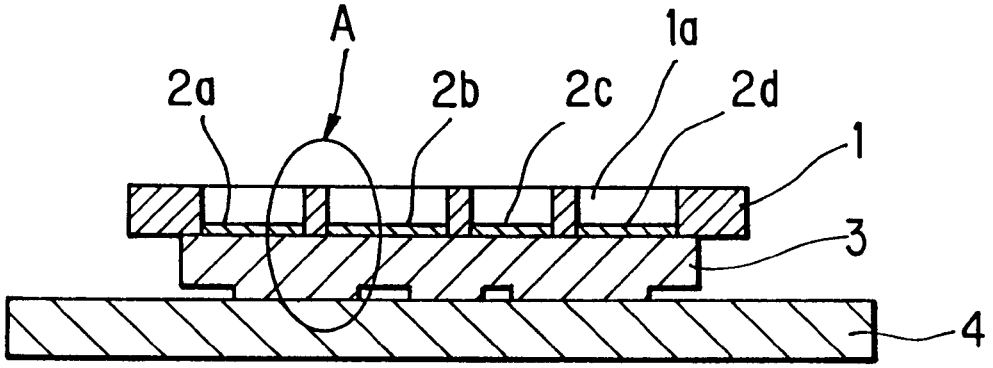
FIG. 2 is a vertical sectional view showing the first embodiment in accordance with a production method of an impregnation stamp of the invention.

The embodiment of a method of producing an impregnation stamp of the invention and the embodiment of an impregnation stamp produced by the method will be described in detail with reference to the accompanying drawings. FIG. 1 is an exploded perspective view showing an embodiment of a filling jig to be used for a production method of an impregnation stamp of the invention. FIG. 2 is a vertical sectional view of the first embodiment in accordance with a production method of an impregnation stamp of the invention. As shown in FIGS. 1 and 2, in order to supply multiple kinds of inks 2*a*–2*d* having different colors, different performances etc., to desired locations, a plurality of filling ports 1*a* of substantially vertical passage holes are formed in a filling frame 1.

The shape of filling port la should not be limited to that shown in FIG. 1, but any shape is possible as long as it can be partitioned so that plural kinds of inks will not mix with each other. A stamp piece 3 has a continuous porous structure and has filling frame 1 laid thereover. Designated at 4 is a base plate which is a jig for holding filling frame 1 together with stamp piece 3. Inks 2*a*–2*d* are made to fill the partitioned areas from filling ports la and impregnate into stamp piece 3 in a substantially similar geometry to that of the areas partitioned by filling ports 1*a*.

Plural kinds of inks 2*a*–2*d* are separated by filling ports 1*a* so that each will not mix with the other and keeping the separated state, fill stamp piece 3 having a continuous porous structure layered below filling frame 1. This configuration enables plural types of inks 2*a*–2*d* to fill desired locations in stamp piece 3.

Figure 3:
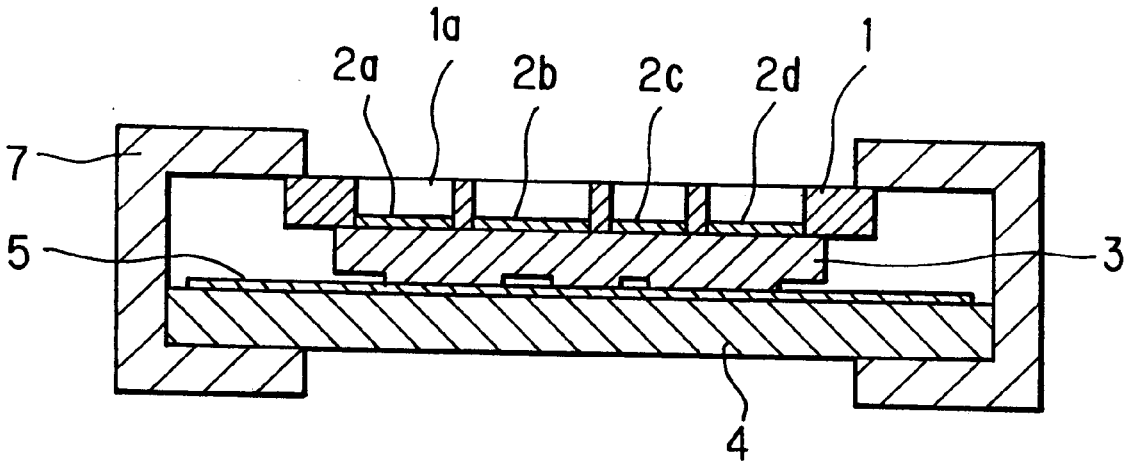
FIG. 3 is a vertical sectional view showing the second embodiment in accordance with a production method of an impregnation stamp of the invention.

FIG. 3 is a vertical sectional view showing the second embodiment in accordance with a production method of an impregnation stamp of the present invention. As shown in FIG. 3, a holding device 7 is provided to press filling frame 1 against stamp piece 3. A sheet 5 is provided between stamp piece 3 and base plate 4 in order to absorb extra ink and hence prevent ink 2*a*–2*d* having permeated through stamp piece 3 from leaching between base plate 4 and stamp piece 3 and mixing with one another.

By pressing filling frame 1 against stamp piece 3 as stated above, filling frame 1 is put into close contact with stamp piece 3 so that inks 2*a*–2*d* before impregnation into stamp piece 3 will not leach between filling frame 1 and stamp piece 3 and hence will not mix with each other across the partitions of filling ports 1*a*. This configuration is particularly effective where the production of the stamp needs a long time for filling.

Figure 4:
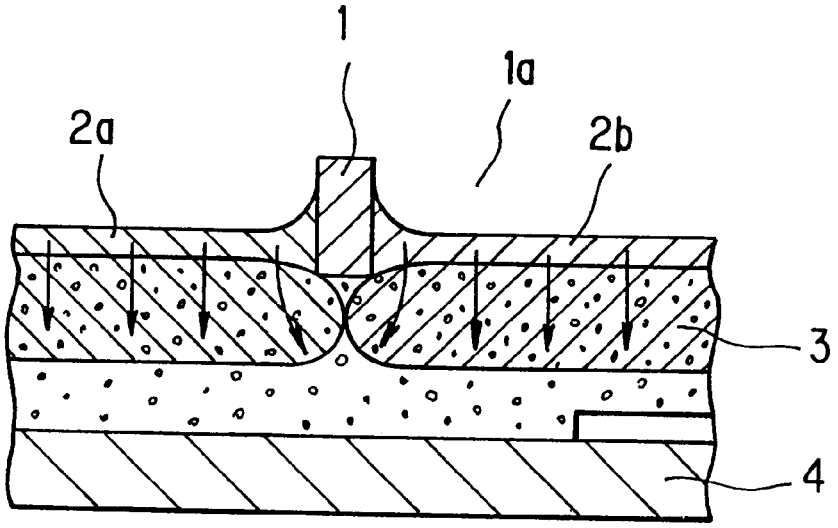
FIG. 4 is a partial enlarged sectional view showing a part A of FIG. 2.
Figure 5:
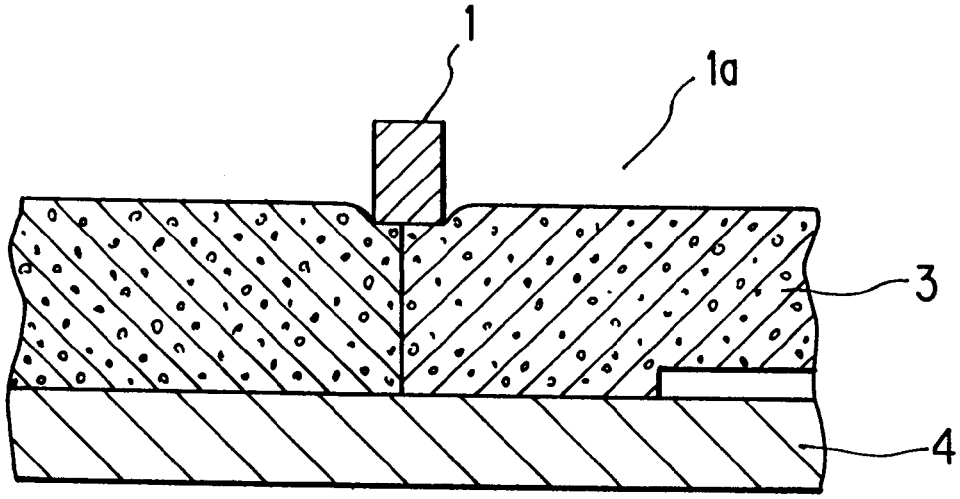
FIG. 5 is a partial enlarged view showing a case where ink impregnation is complete.

FIG. 4 is a partial enlarged sectional view showing a part A of FIG. 2. FIG. 5 is a partial enlarged view showing a case where ink impregnation is complete. As shown in FIG. 4, inks 2*a* and 2*b* fill stamp piece 3 through respective filling ports 1*a* of filling frame 1 so that they impregnate into stamp piece 3 whilst being separated by filling ports 1*a* in the direction of the arrows without mixing with each other. Thus, inks 2*a* and 2*b* fill stamp piece 3 separately as shown in FIG. 5.

Figure 6:
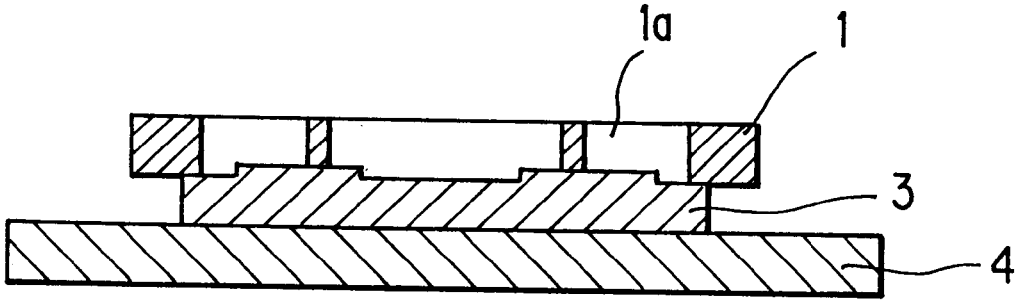
FIG. 6 is a vertical sectional view showing the third embodiment in accordance with a production method of an impregnation stamp of the invention.

FIG. 6 is a vertical sectional view showing the third embodiment in accordance with a production method of an impregnation stamp of the invention. As shown in FIG. 6, this production method is basically the same as that shown in FIG. 2, except in that filling of ink into stamp piece 3 is performed from the stamping face of the stamp piece. As shown herein, filling frame 1 is shaped to meet the surface feature (raised and incised levels) of the stamping face of stamp piece 3. This configuration enables complete separation between different colors of ink even if the stamping surface has a large level difference between raised and incised portions.

Figure 7:
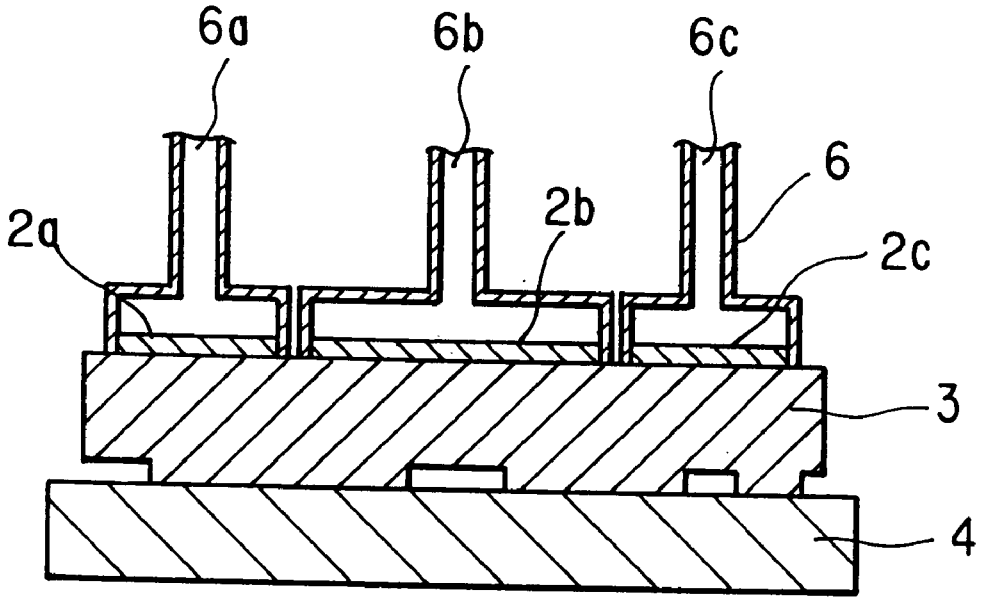
FIG. 7 is a vertical sectional view showing the fourth embodiment in accordance with a production method of an impregnation stamp of the invention.

FIG. 7 is a vertical sectional view showing the fourth embodiment in accordance with a production method of an impregnation stamp of the invention. As shown in FIG. 7, a filling frame 6 has filling ports 6*a*–6*c* each having a tube for separating ink at the end and is laid over stamp piece 3. This tubular configuration of filling ports 6*a*–6*c* can easily separate plural types of inks 2*a*–2*c* from one another.

Figure 8:
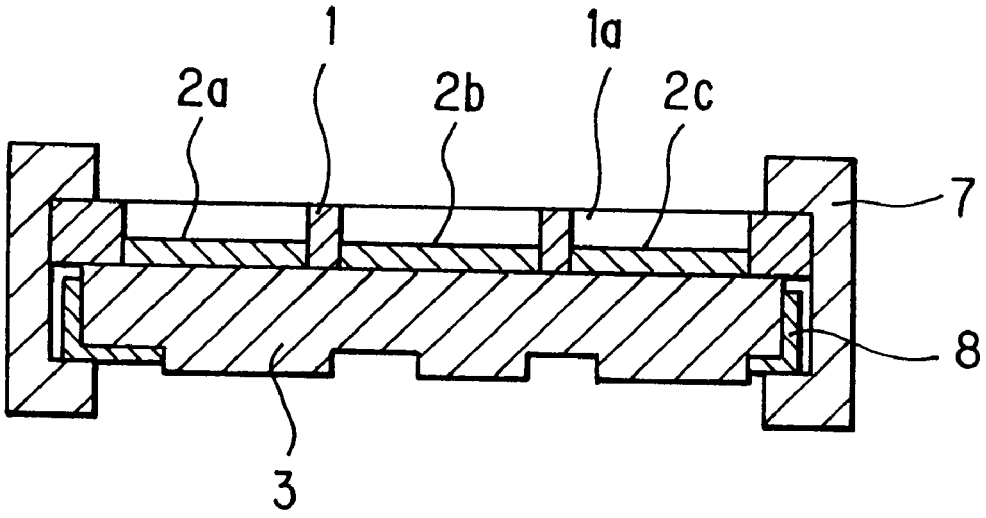
FIG. 8 is a vertical sectional view showing the fifth embodiment in accordance with a production method of an impregnation stamp of the invention.

FIG. 8 is a vertical sectional view showing the fifth embodiment in accordance with a production method of an impregnation stamp of the invention. As shown in FIG. 8, stamp piece 3 is incorporated in a holder 8 and is pressed against filling frame 1 through holder 8 by holding device 7.

Figure 9:
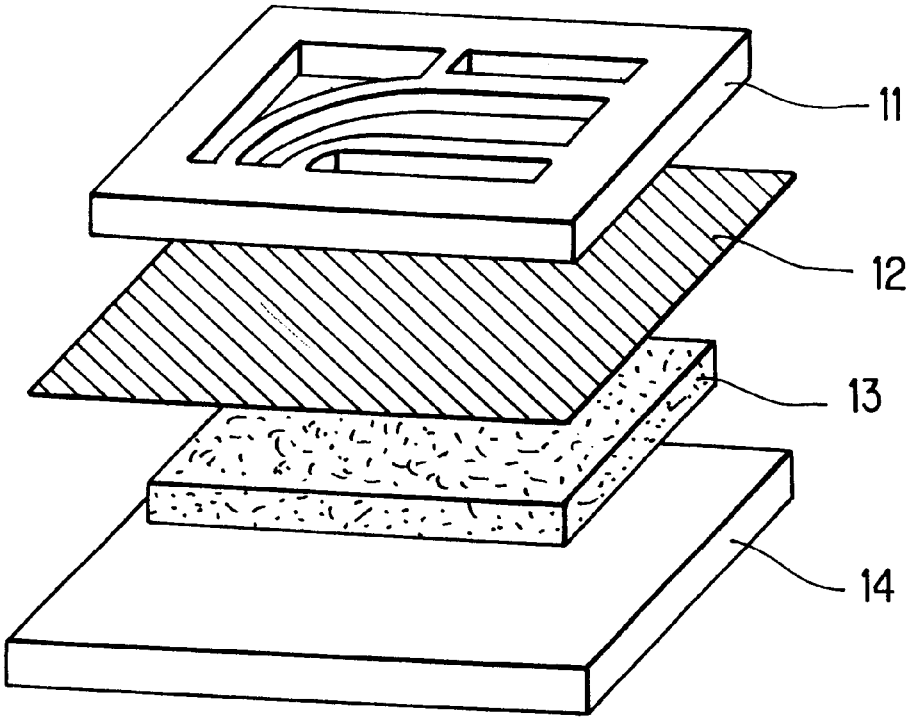
FIG. 9 is an exploded perspective view showing another embodiment of a filling jig to be used for a production method of an impregnation stamp of the invention.

FIG. 9 is an exploded perspective view showing another embodiment of a filling jig to be used in the production method of an impregnation stamp of the invention. A filling frame 11 has a plurality of filling ports 11*a* of substantially vertical passage holes partitioned therein allowing plural kinds of inks having different colors, performances etc. to be supplied in a desired geometry. The shape of filling port 11*a* should not be limited to that shown in FIG. 9, but any shape is possible as long as it can be partitioned so that plural kinds of ink will not mix with each other. A diffusion sheet 12 is made up of a material which is permeable by ink and allows the impregnated ink to diffuse therein by capillary effect. Specific examples of diffusion sheet 12 are prepared from screens of natural fabrics such as paper, silk, cotton, Manila hemp etc., screens of chemical fabrics such as vinylon, nylon, polyester, rayon etc., screens made up of metallic fibers, glass fibers etc. and porous materials having a continuous porous structure made up of natural rubber, synthetic rubber, or plastic. A stamp piece 13 has a continuous porous structure. A base plate 14 is a jig for holding stamp piece 13 together with filling frame 11.

Figure 10:
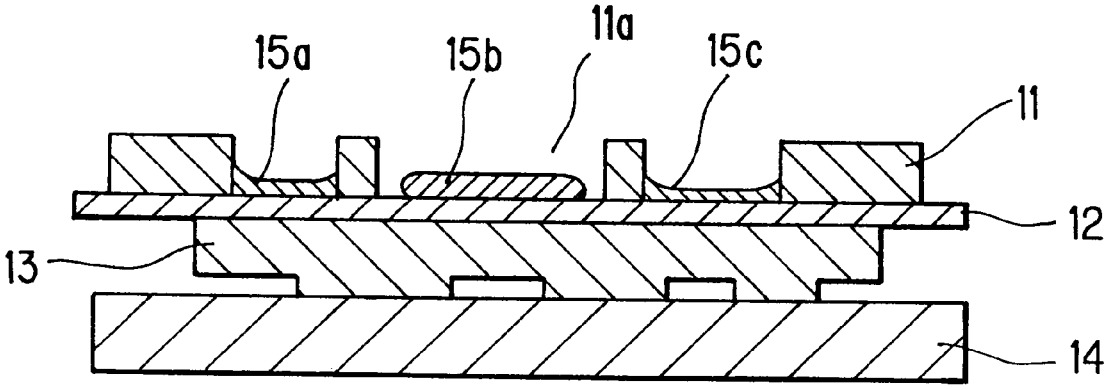
FIG. 10 is a vertical sectional view showing the sixth embodiment in accordance with a production method of an impregnation stamp of the invention.

FIG. 10 is a vertical sectional view showing the sixth embodiment in accordance with a production method of an impregnation stamp of the invention, showing a section of the state where the stamp is produced using the jig shown in FIG. 9. Filling frame 11 presses against stamp piece 13 due to gravity via diffusion sheet 12. Plural kinds of inks 15*a*–15*c* fill areas partitioned by filling ports 11*a* and impregnate into diffusion sheet 12. Inks 15*a*–15*c* impregnate into stamp piece 13 diffusing due to capillary effect inside diffusion sheet 12. Since ink uniformly diffuses due to capillary effect up to areas where the fabric or porous structure is confined or almost confined by the pressing contact of filling frame 11 into stamp piece 13 or adhesion or welding between diffusion sheet 12 and filling frame 11, the diffusion areas are identical with the areas partitioned by filling ports 11*a*. Accordingly, the resulting geometry of ink 15*a*–15*c* filling stamp piece 13 from diffusion sheet 12 also becomes identical to the areas partitioned by filling ports 11*a*, thus making it possible to make plural kinds of ink 15*a*–15*c* fill a single stamp piece 13 in a desired geometry.

Figure 11:
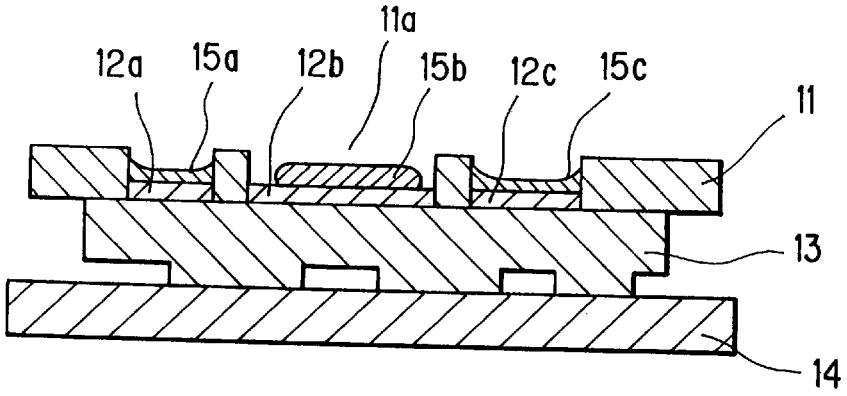
FIG. 11 is a vertical sectional view showing the seventh embodiment in accordance with a production method of an impregnation stamp of the invention.

FIG. 11 is a vertical sectional view showing the seventh embodiment in accordance with a production method of an impregnation stamp of the invention. Similarly to FIG. 10, this figure shows a section of the state where the stamp is produced using the jig shown in FIG. 9. Filling frame 11 presses against stamp piece 13 due to gravity. Inks 15*a*–15*c* penetrate into diffusion sheet pieces 12*a*–12*c* which are formed into the same shapes as those partitioned by filling ports 11*a* and put into respective filling ports 11*a*. Inks 15*a*–15*c* impregnating into diffusion sheet pieces 12*a*–12*c* uniformly diffuse due to capillary effect into the areas partitioned by diffusion sheet pieces 12*a*–12*c*, or in this case, partitioned by filling ports 1*a*. Inks 15*a*–15*c* filling stamp piece 13 from diffusion sheet pieces 12*a*–12*c*, are distributed in the same geometry as the areas partitioned by filling ports 11*a*, thus allowing plural kinds of inks 15*a*–15*c* to fill stamp piece 13 in a desired geometry.

Figure 12:
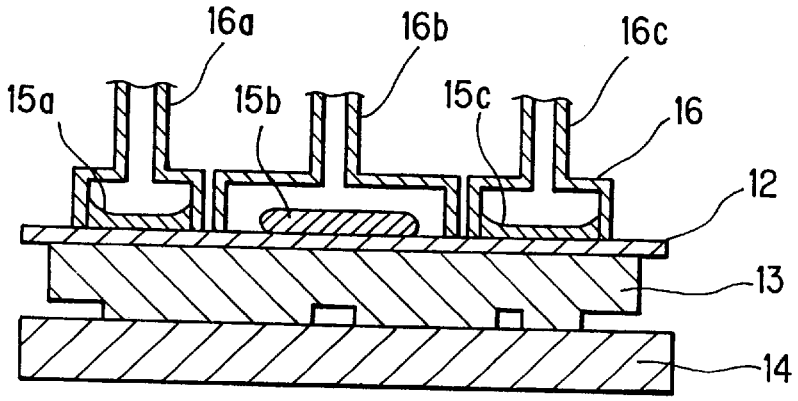
FIG. 12 is a vertical sectional view showing the eighth embodiment in accordance with a production method of an impregnation stamp of the invention.

FIG. 12 is a vertical sectional view showing the eighth embodiment in accordance with a production method of an impregnation stamp of the invention. As shown in FIG. 12, a filling frame 16 has filling ports 16*a*–16*c* each having a tube for ink separation at the end and is laid over stamp piece 3 with diffusion sheet 12 in between. This tubular configuration of filling ports 16*a*–16*c* can easily separate plural types of inks 15*a*–15*c* from one another.

Figure 13:
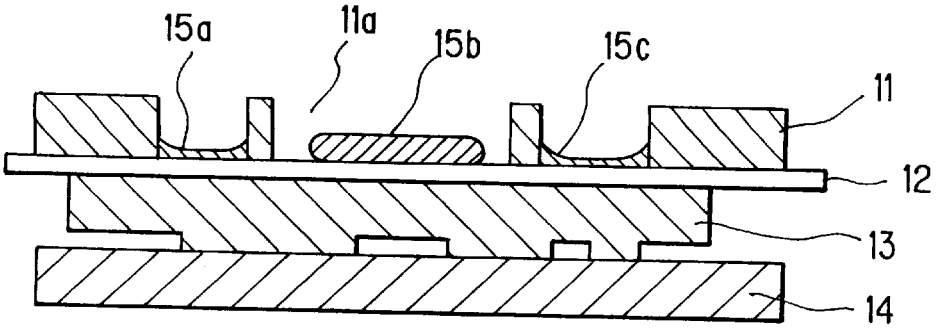
FIG. 13 is a vertical sectional view showing the state immediately after separate injection of ink in the production method of an impregnation stamp of the invention.
Figure 14:
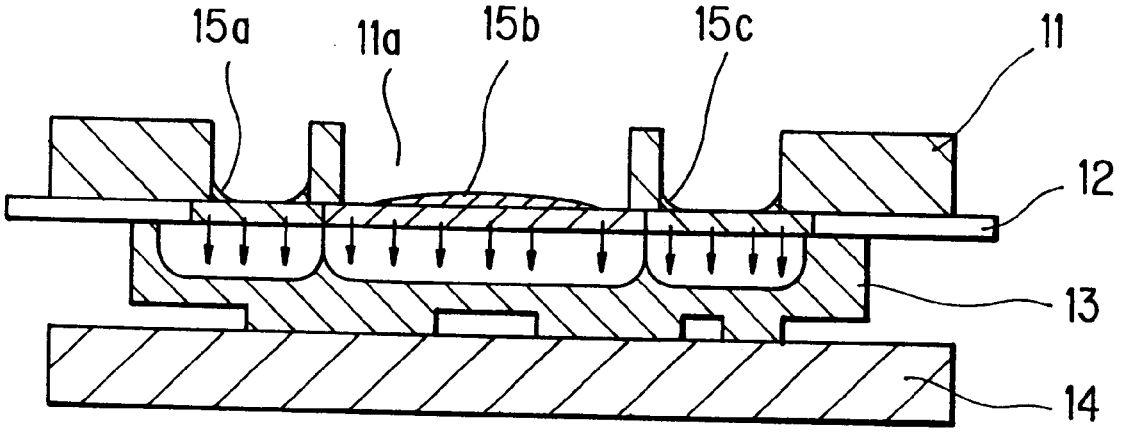
FIG. 14 is a vertical sectional view showing the state where ink having impregnated and disposed throughout the diffusion sheet permeates a stamp piece.
Figure 15:
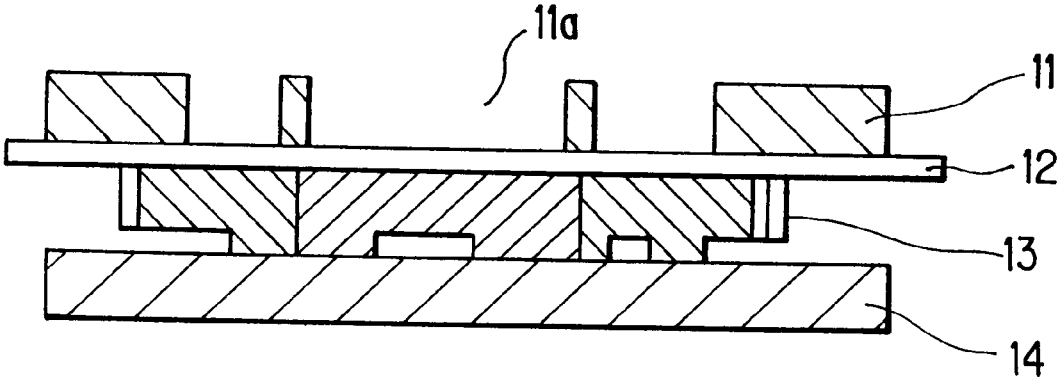
FIG. 15 is a vertical sectional view showing the state where impregnation of ink into the stamp piece is complete.

FIG. 13 is a vertical sectional view showing the state immediately after separate injection of ink in the production method of an impregnation stamp of the invention. Concerning inks 15*a*–15*c* after the separate injection, ink tends to be raised toward the wall face of filling port 11*a* due to surface tension where the area partitioned by filling port 11*a* is relatively narrow while ink tends to collect together in the center and does not spread overall when the area partitioned by filling port 11*a* is relatively large. However, in the state where inks 15*a*–15*c* have impregnated throughout diffusion sheet 12, inks 15*a*–15*c* permeate stamp piece 13 while diffusing throughout diffusion sheet 12 due to capillary effect. Since ink uniformly diffuses due to capillary effect up to areas where the fabric or porous structure is confined or almost confined by the pressing contact of filling frame 11 onto stamp piece 13, or adhesion or welding between diffusion sheet 12 and filling frame 11, the diffusion areas are identical as the areas partitioned by filling ports 11*a* as shown in FIGS. 14 and 15. Accordingly, the resulting geometry of inks 15*a*–15*c* filling stamp piece 13 from diffusion sheet 12 also become identical to the areas partitioned by filling ports 11*a* shown in FIG. 10, thus making it possible to make plural kinds of inks 15*a*–15*c* fill a single stamp piece 13 in a desired geometry. Here, when the materials are chosen so that the capillary force of diffusion sheet 12 is lower than that of stamp piece 13, ink can smoothly impregnate from diffusion sheet 12 into stamp piece 13, making it possible to reduce the residual amount of ink inside diffusion sheet 12 as well as shorten the time for impregnation.

The colorant of ink used in the present invention may be of either pigment or dye. In the case where plural kinds of ink supplied in the finished stamp need to be prevented from mixing with each other over a long period, pigments are preferably used as the main component while dyes are added as a supplement. It is also possible to use dyes alone if inhibition of color mixing is not an important feature. In the present invention, the pigments and dyes used in the ink can be of pigments and dyes usually used for writing implements. Further, in the present invention, when plural kinds of inks are used, a common vehicle is used. Further, as long as the compatibility between colorants can be secured with a common vehicle, various combinations of the colorants, i.e., dyes only, dyes and pigments, and pigments only can be arranged side by side.

As the pigment, such inorganic or organic pigments as titanium oxide, carbon black, phthalocyanine, azo-pigments, anthraquinone, quinacridone etc. may be directly used. Alternatively, these pigments can be surface modified with resin, surfactant or the like and used as processed pigments.

As the dye, basic dyes, acid dyes, direct dyes and the like may be used. It is also possible to use solubilized or microcapsulized dyes. Examples include 'Valifast Black #1802', 'Valifast Black #1805', 'Valifast Black #3820', 'Valifast Violet#1701', 'Oil Blue 613', 'Valifast Blue 2620', 'Valifast Yellow AUM' and 'Valifast Yellow #3104', all products of ORIENT CHEMICAL INDUSTRY CO., LTD.,; 'Spilon Violet C-RH', 'Spilon Black CMH special' 'Spilon Yellow C-GNH', 'Spilon Orange GRH', 'Spilon Red C-GH', 'SBN Orange '701', 'Spilon Red GRLH' and 'Spilon Red BEH' all products of HODOGAYA CHEMICAL CO., LTD., and also auramine, rhodamine etc.

The added amounts of these inks are not particularly limited as long as they fall within the suitable ranges of solubility and diffusibility and meet the desired hue and density. The amount of ink, however, strongly relates to the density of impression and ejected amount of ink; if the added amount is too large, the density of the impression becomes high, but the ejected amount becomes less, shortening the life of the impregnation stamp. Conversely, if the added amount is too low, the life of the stamp becomes long, but the coloring of the impression degrades. In general, 3 to 20 wt. % is preferable for the total amount of ink.

The vehicle used for preparation of the ink is composed of a single kind of dispersible resin and one kind or two or more kinds of solvents. Here, the dispersible resin may be used if it is assumed to be one kind insofar as the degree of polymerization varies, and as the example, polyvinyl butyral resin and ethylcellose resin can be used. As the solvent, a glycol group such as octylen glycol, a polyalkylene glycol group such as polyethylene glycol, polypropylene glycol, etc., a glycoether group such as diethylene glycol monobutyl ether, a fatty acid ester group such as ethylene glycol monoricinolate, propylene glycol monoricinolate etc., caster oil fatty acid methyl ester, oleic acid polyoxyethylene glycol monoether, polyoxypropylene glycol monoether etc. can be used. Besides the above, resins, surfactant, preservative, dispersion adjuvant etc., may be appropriately added as required.

In the invention, the solvent constituting the vehicle preferably has a vapor pressure of 0.1 mmHg/25° C. or less related to its volatility at air temperature, so as to exhibit satisfactory stamping performances. The liquid ink mixture which is composed of the above vehicle and the above ink preferably has a viscosity of 30 to 2,500 mPa.s, for the following reasons:—that is, the liquid ink mixture having a viscosity falling within the above range provides good continuous use of printing body and satisfactory ink separation performance. If it is lower than the above range, the ink can be filled smoothly, but the ink will be ejected abundantly during stamping and hence the resultant impression will bleed greatly and exhibit lack of sharpness. If the viscosity is higher than the above range, it becomes difficult for ink to be filled, and the reproducibility of ink impressions in sequential stamping will degrade, also the tackiness after stamping becomes large, producing ink strings.

As an example of the material to be used for the stamp piece having a continuous porous structure of the invention, sponge rubber having a porosity of 30 to 80% and a sponginess (spring hardness) of 20 to 65 can be used. The sponge rubber may be of acrylic rubber, nitrile rubber, Butyl-rubber, acrylonitrile butadiene rubber, ethylene propylene rubber, ethylene butylen rubber, chloroethene rubber, EPDM (ethylene propylene diene copolymer) etc.

In accordance with the method of producing an impregnation stamp and an impregnation stamp produced thereby, it is possible to fill a single stamp piece with plural kinds of ink, thus allowing the resultant stamp to form an impression of plural types of ink in a single stamping action. Further, the resulting impression consisting of plural kinds of ink is free from boundaries, producing a natural print. Further, when ink is supplied to sectioned areas through the filling ports, there is no need to supply ink uniformly to the areas. Therefore, the jig and device for ink filling can be simplified and the variance of the products during ink filling can be reduced.

What is claimed is:

1. A method of producing an impregnation stamp with a stamp piece of a continuous porous structure filled with ink to enable repeated stamping, comprising the steps of:

laying a filling frame with a plurality of filling ports of substantially vertical passage holes over a stamp piece having a continuous porous structure; and injecting at least two kinds of ink to respective filling ports to thereby supply plural types of ink into the stamp piece.

2. The method of producing an impregnation stamp according to claim 1, wherein in the step of laying the filling frame, a diffusion sheet which is permeable by ink and allows the impregnated ink to diffuse therein by capillary effect is placed between the filling frame and the stamp piece.

3. The method of producing an impregnation stamp according to claim 2, wherein the capillary force of the diffusion sheet is set weaker than that of the stamp piece.

4. The method of producing an impregnation stamp according to claim 2, wherein in the step of laying the filling frame, the filling frame is put in pressure contact with the stamp.

5. The method of producing an impregnation stamp according to claim 1, wherein in the step of laying the filling frame, the filling frame is put in pressure contact with the stamp piece.

* * * * *